US006417434B1

(12) United States Patent
Lao

(10) Patent No.: US 6,417,434 B1
(45) Date of Patent: Jul. 9, 2002

(54) ADJUSTABLE TWO LAYER CYMBAL STRUCTURE

(76) Inventor: Tsun-Chi Lao, No. 14, Chun-Kung Rd., Pei-Tun Dist., Taichung City (TW)

( * ) Notice: Subject to any disclaimer, the term of this patent is extended or adjusted under 35 U.S.C. 154(b) by 0 days.

(21) Appl. No.: 09/779,632

(22) Filed: Feb. 9, 2001

(51) Int. Cl.[7] ..... G10D 13/02
(52) U.S. Cl. ..... 84/422.3; 84/422.1; 84/422.2
(58) Field of Search ..... 84/422.1, 422.2, 84/422.3

(56) References Cited

U.S. PATENT DOCUMENTS 5,266,733 A * 11/1993 Jacobson ..... 84/422.3
6,034,313 A * 3/2000 Shelley ..... 84/422.3
6,075,192 A * 6/2000 Hoshino ..... 84/422.3

* cited by examiner

*Primary Examiner*—Robert E. Nappi
*Assistant Examiner*—Kim Lockett
(74) *Attorney, Agent, or Firm*—Bacon & Thomas, PLLC

(57) ABSTRACT

An adjustable two layer cymbal structure is disclosed. An adjustable spring is added at a lower side of the rotary seat of the adjustable seat for resisting against the adjustable seat. The rotary seat is adjusted upwards conveniently, rapidly and easily, and thus a preferred sound effect is achieved. Therefore, the prior art copper cymbal frame can be installed with a two layer copper cymbal or a two layer copper cymbal and a single one copper cymbal.

2 Claims, 6 Drawing Sheets

ADJUSTABLE TWO LAYER CYMBAL STRUCTURE

BACKGROUND OF THE INVENTION

The present invention relates to an adjustable two layer cymbal structure, particularly the distance between an upper cotton piece and a lower cotton piece are adjustable so that different sound fields from different vibration ways are provided.

In general, an elevated copper cymbal frame (1) is only locked with a single copper cymbal (2) (see FIG. 1, a prior art copper cymbal frame with a single one copper cymbal is illustrated). Once knocking the frame, only one beautiful sound is generated from the copper cymbal.

In another design, a pedal type copper cymbal frame is provided. The upper and lower copper cymbal are collided to one another so as to generate two different sounds which are possible resonant or not resonant. As the distance of the two copper cymbals are adjusted, the resonance of the two copper cymbals are adjusted. In general, the copper cymbal frame is installed with a lower copper cymbal support for supporting an lower copper cymbal and an upper copper cymbal support for supporting an upper copper cymbal. In this designed, the position of the upper copper cymbal is adjusted by adjusting the upper copper cymbal support. In the operation, the butterfly stud on the upper copper cymbal support must be adjusted and then the upper copper cymbal support is moved to a proper position. Then, the butterfly stud is adjusted. Only the position of the upper copper cymbal is adjusted, while the position of the lower copper cymbal is not adjusted. Furthermore, the adjusting work can not be performed in playing so that the whole sound effect is not preferred. Therefore, there is an eager demand for a novel copper cymbal structure, in which the distance between two copper cymbals is adjusted rapidly and conveniently. Moreover, the copper cymbals can be embodied in a general high copper cymbal frame so as to present a convenient sound effect.

SUMMARY OF THE INVENTION

Accordingly, the primary object of the present invention is to provide an adjustable two layer cymbal structure, wherein an adjustable spring is added at a lower side of the rotary seat of the adjustable seat for resisting against the adjustable seat. The rotary seat is adjusted upwards conveniently, rapidly and easily, and thus a preferred sound effect is achieved.

Another object of the present invention is to provide an adjustable two layer cymbal structure, wherein the supporting pillar is tightly fastened to the cross section of the positioning rod cover and a further connecting rod is further added so that various ways for installing copper cymbals are provided.

To achieve above objects, the present invention provides an adjustable two layer cymbal structure. An adjustable spring is added at a lower side of the rotary seat of the adjustable seat for resisting against the adjustable seat. The rotary seat is adjusted upwards conveniently, rapidly and easily, and thus a preferred sound effect is achieved. Therefore, the prior art copper cymbal frame can be installed with a two layer copper cymbal or a two layer copper cymbal and a single one copper cymbal.

The various objects and advantages of the present invention will be more readily understood from the following detailed description when read in conjunction with the appended drawing.

DETAILED DESCRIPTION OF THE PREFERRED EMBODIMENTS

Figure 1:
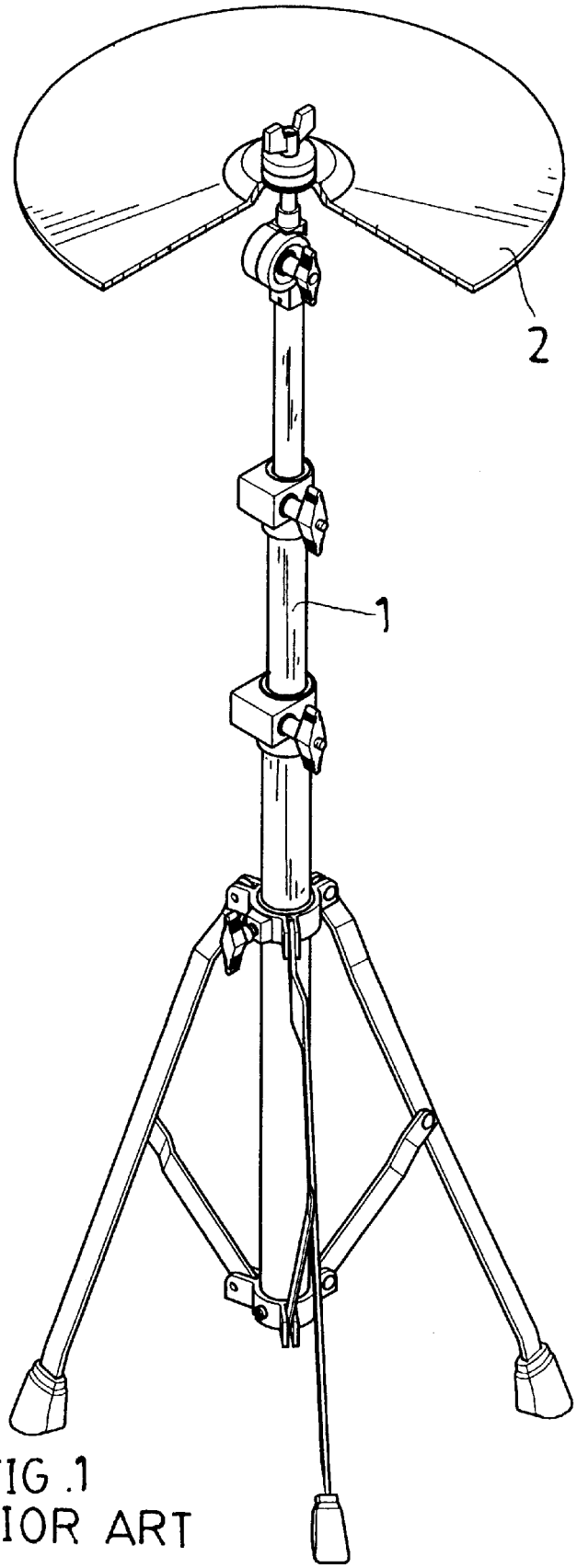
FIG .1 PRIOR ART
FIG. 1 is a perspective view of a prior art copper cymbal frame with a single one copper cymbal.

Referring to FIGS. 2 to 6, the adjustable two layer cymbal structure of the present invention is illustrated. The adjustable two layer cymbal structure of the present invention mainly includes the following elements.

A positioning rod cover (10): The positioning rod cover (10) has an outer thread (11). A rod portion (12) at an upper end of the outer thread (11). An extension with a rectangular cross-section (13) is installed at the upper end of the rod portion (12).

A lower copper cymbal support: The lower copper cymbal support has an adjustable seat (21) and a rotary seat (22) two sides of which are protruded with rotary handles. The center of the rotary seat (22) is installed with a screw hole for screwing to the outer thread (11) of the positioning rod cover (1O). An adjustable spring (23) is added at a lower side of the rotary seat (22) of the adjustable seat (21) for resisting against the adjustable seat (21). A nut (24), an upper cotton piece (25), and a lower cotton piece (26) are screwedly installed on the upper side of the adjustable seat (21). A lower copper cymbal (T1) can be clamped by the upper cotton piece (25) and the lower cotton piece (26).

An upper copper cymbal support: The upper copper cymbal support has a supporting pillar (32) with a butterfly stud (31) for fixing the supporting pillar (32) to the two parallel cross sections (13) of the positioning rod cover (10). The fixing way is more tightened than the prior art round rod. The supporting pillar (32) is sequentially screwedly installed with an upper spacer (33), an upper cotton piece (34), a lower cotton piece (35) and an adjustable nut (36). An upper copper cymbal (T2) is clamped by the upper cotton piece (34) and lower cotton piece (35). By adjusting the butterfly stud (31) and upper copper cymbal support, the upper copper cymbal (T2) can be adjusted.

Figure 2:
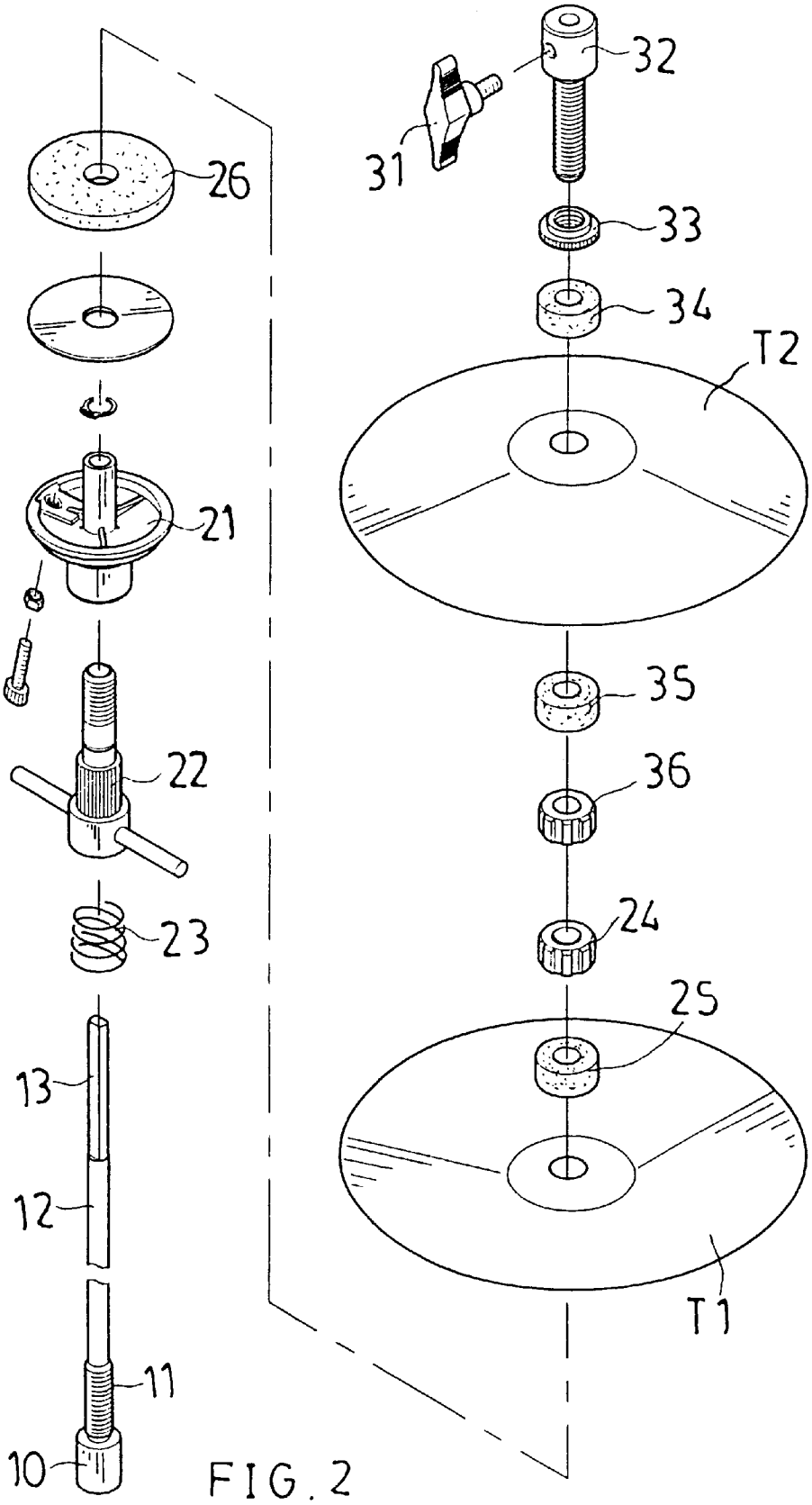
FIG. 2 is an exploded perspective view of the present invention.
Figure 3:
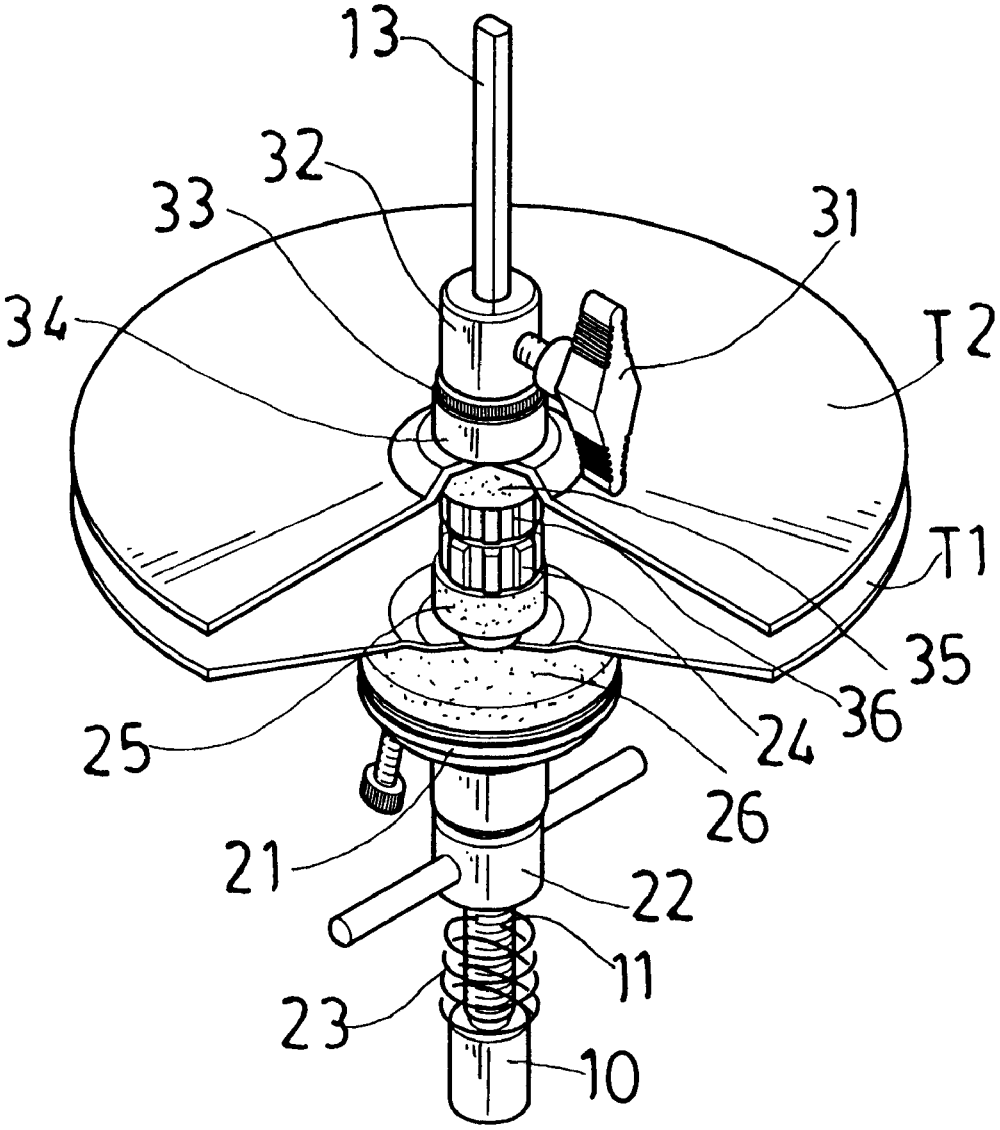
FIG. 3 is an assembled perspective view of the present invention.
Figure 4B:
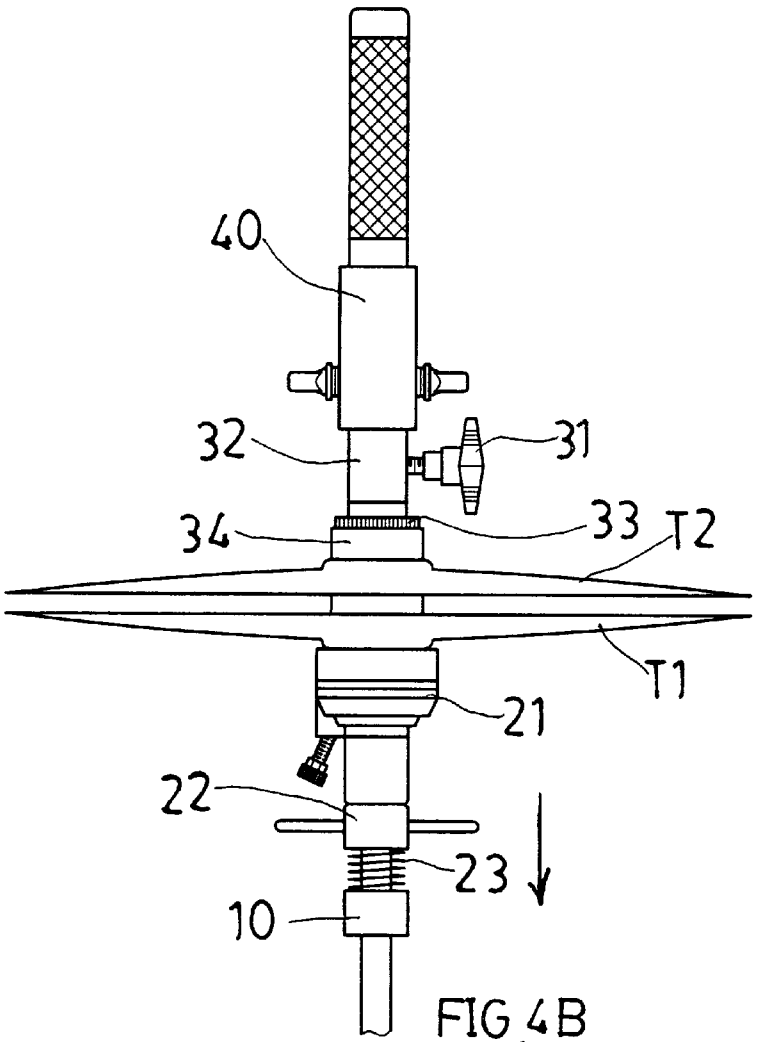
FIG. 4B is a schematic view showing the action of FIG. 4A.
Figure 4A:
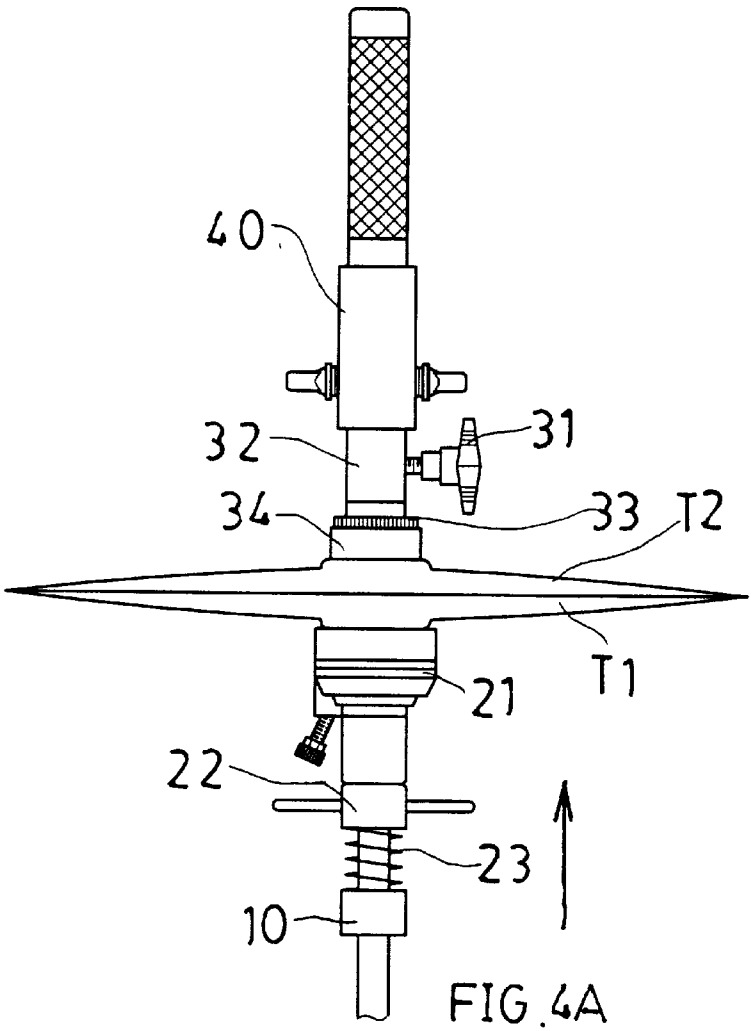
FIG. 4A is a plane schematic view of the present invention.

The present invention shown in FIG. 3 is assembled from the element of FIG. 2. If the distance between the upper copper cymbal (T2) and the lower copper cymbal (T1), it is needless to release or tighten the butterfly stud (31) for adjusting the position of the supporting pillar (32). Whereas, in the present invention, it is only necessary to rotate the rotary seat (22) of the adjustable seat (21) so that the adjustable seat (21) moves upwards or downwards for adjusting the distance between two copper cymbals (referring to FIG. 4). Furthermore, by elastic force of the adjustable spring (23) to resist against the adjustable seat (21) to be adjusted upwards. Thus, the effect in adjusting is preferred and the sound effect is also improved. Moreover, the adjustable spring (23) may resist against the adjustable seat (21) in order to prevent the two copper cymbals from moving downwards as they are knocked. This is an advantage of the present invention.

The extension (13) is installed at an upper end of the rod portion (12) of the positioning rod cover (10) for being enclosed by the supporting pillar (32), and when the butterfly stud (31) is locked, the locking arrangement is more fastened. This is another advantage of the present invention.

Figure 5:
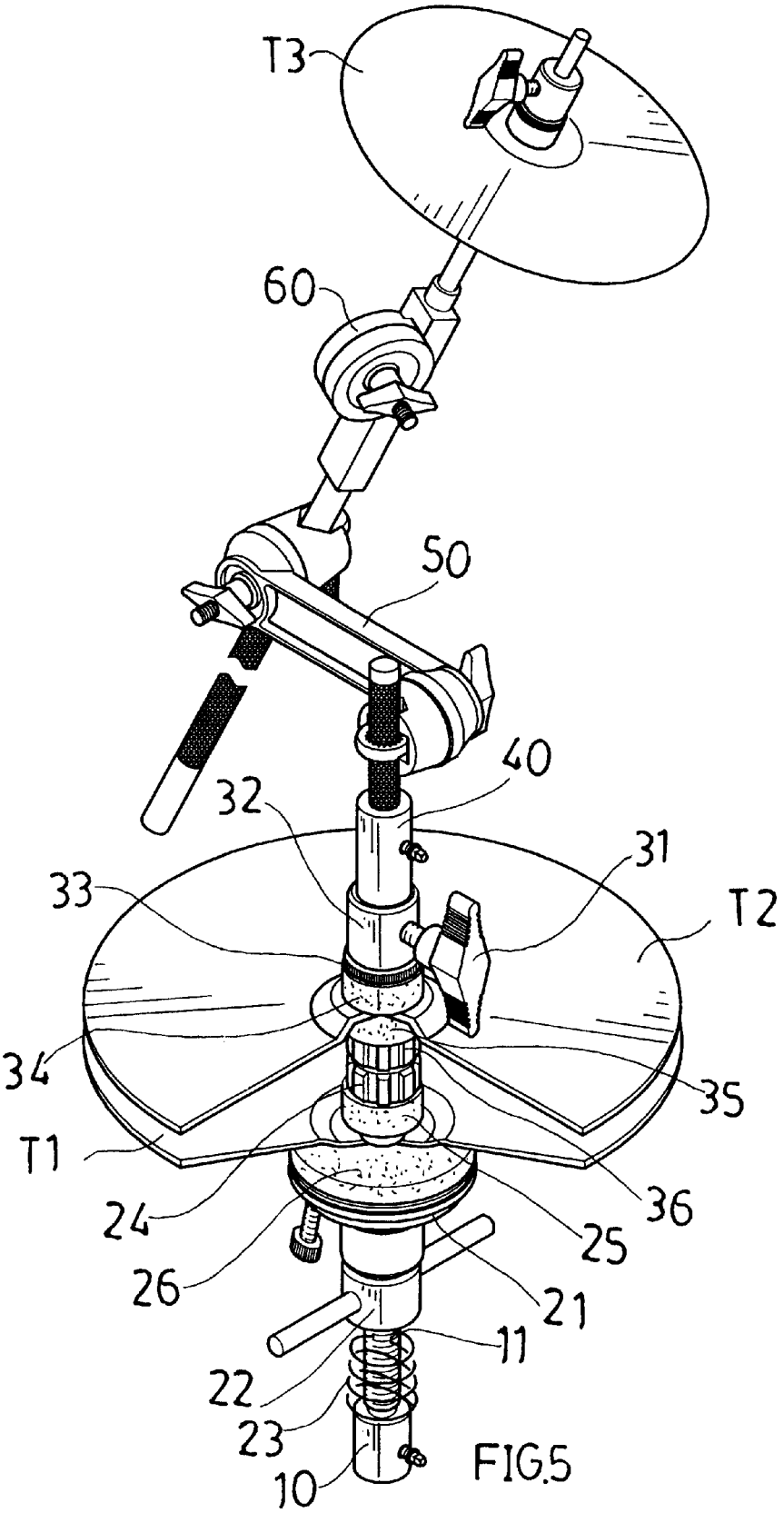
FIG. 5 is a schematic view showing the application of the present invention.
Figure 6:
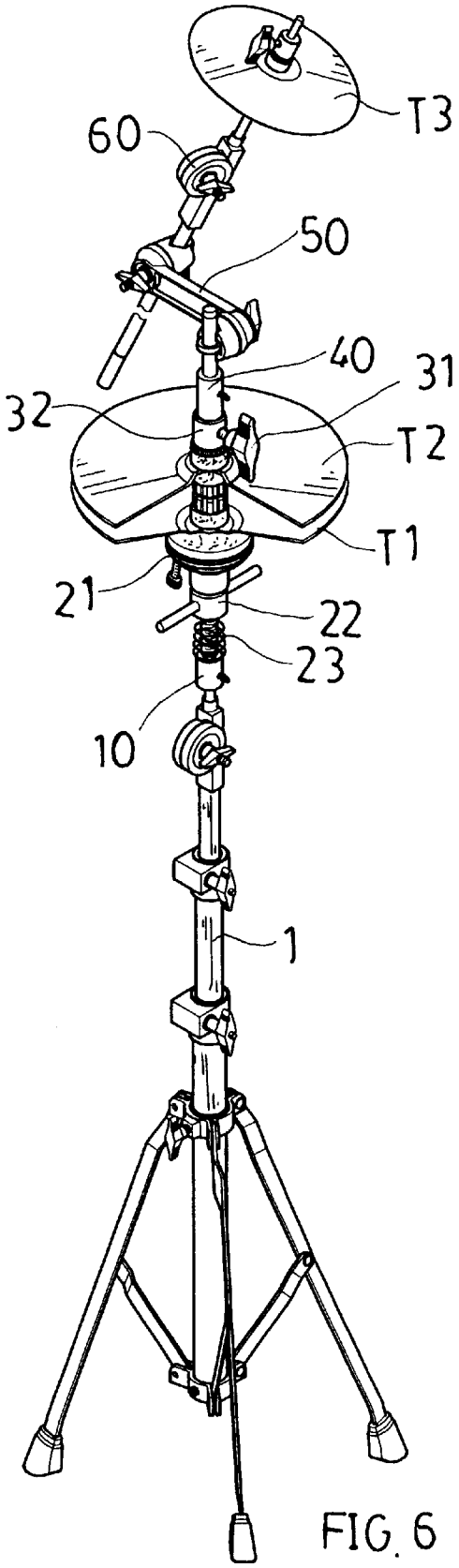
FIG. 6 is a schematic view showing another embodiment in the present invention.

Referring to FIGS. 5 and 6, the extension (13) is installed at an upper end of the rod portion (12) of the positioning rod cover (10) for being enclosed by a connecting cover (40). The connecting cover (40) clamps an angle adjusting seat (60) by an aspect adjuster (50). Thereby, another set of copper cymbals (T3) are fixed.

The prior art copper cymbal (2) can be taken down, and the connecting cover (40), aspect adjuster (50), and the set of angle adjusting seat (60) are installed to a prior art copper cymbal frame (1). Therefore, as shown in FIG. 6, the prior art copper cymbal frame (1) has the upper copper cymbal (T2) and lower copper cymbal (T1) so that the upper copper cymbal (T2), lower copper cymbal (T1) and another copper cymbal (T3) are mounted on the copper cymbal frame (1). As the user knocks the device, multiple and different sound effects are presented.

The present invention has the follow advantage:

1. An adjustable spring (23) is added at a lower side of the rotary seat (22) of the adjustable seat (21) for resisting against the adjustable seat (21). The rotary seat is adjusted upwards conveniently, rapidly and easily, and thus a preferred sound effect is achieved.
2. The adjustable spring (23) may directly support the adjustable seat (21) for preventing the two copper cymbals from moving downwards due to the vibration in knocking the cymbals.
3. In the present invention, the single copper cymbal in the prior art copper cymbal frame (1) can be replaced as a two layer copper cymbals.
4. In the present invention, the prior art copper cymbal frame (1) can be installed with a two layer copper cymbal and a single one copper cymbal.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An adjustable cymbal structure comprising:

a cymbal frame;

a positioning rod cover comprising a lower portion, an outer thread portion, a rod portion, and an extension with a rectangular cross-section, the lower portion attached to an end of the cymbal frame, the outer thread portion extending away from the lower portion, the rod portion connecting the outer thread portion and the extension;

a spring;

a rotary seat including a first bore therethrough to permit the extension to extend therethrough, the bore including a screw hole, the screw hole threaded on the outer thread portion of the positing rod cover with the spring secured between the rotary seat and the lower portion of the positioning rod cover;

an adjusting seat including a second bore therethrough to permit the extension to extend therethrough to the rotary seat, the adjusting seat adapted to receive a lower cymbal thereon, the lower cymbal secured on to the adjustable seat;

a supporting pillar adjustably attached to the extension;

an upper cymbal secured to the supporting pillar, such that the upper cymbal is secured at a desired position along the length of the extension; and the rotary seat is rotatable on the outer thread portion to compress or decompress the spring to bring the lower cymbal to a desired distance to the upper cymbal.

2. The adjustable cymbal structure as claimed in claim 1, wherein the cymbals comprise copper material.

* * * * *